US009172147B1

(12) United States Patent
Manry, Jr.

(10) Patent No.: US 9,172,147 B1
(45) Date of Patent: Oct. 27, 2015

(54) ULTRA WIDE BAND ANTENNA ELEMENT

(71) Applicant: The Boeing Company, Chicago, IL (US)

(72) Inventor: Charles W. Manry, Jr., Auburn, WA (US)

(73) Assignee: The Boeing Company, Chicago, IL (US)

( * ) Notice: Subject to any disclaimer, the term of this patent is extended or adjusted under 35 U.S.C. 154(b) by 118 days.

(21) Appl. No.: 13/771,641

(22) Filed: Feb. 20, 2013

(51) Int. Cl.
*H01Q 1/38* (2006.01)
*H01Q 21/26* (2006.01)

(52) U.S. Cl.
CPC ..... *H01Q 21/26* (2013.01)

(58) Field of Classification Search
USPC ..... 343/700 MS, 705, 829, 846
See application file for complete search history.

(56) References Cited

U.S. PATENT DOCUMENTS

| | | | | |
|---|---|---|---|---|
| 2,994,876 | A * | 8/1961 | Josephson | 343/803 |
| 3,137,002 | A * | 6/1964 | Kaiser, Jr. et al. | 342/365 |
| 3,922,683 | A * | 11/1975 | Kumpebeck | 343/797 |
| 4,477,813 | A | 10/1984 | Weiss | |
| 4,684,952 | A | 8/1987 | Munson et al. | |
| 4,783,661 | A | 11/1988 | Smith | |
| 5,589,834 | A | 12/1996 | Weinberg | |
| 5,786,792 | A | 7/1998 | Bellus et al. | |
| 5,786,793 | A | 7/1998 | Maeda et al. | |
| 5,923,289 | A | 7/1999 | Buer et al. | |
| 6,114,996 | A * | 9/2000 | Nghiem | 343/700 MS |
| 6,181,280 | B1 | 1/2001 | Kadambi et al. | |
| 6,359,599 | B2 | 3/2002 | Apostolos | |
| 6,380,905 | B1 * | 4/2002 | Annamaa et al. | 343/767 |
| 6,407,716 | B1 | 6/2002 | Strickland et al. | |
| 6,448,938 | B1 | 9/2002 | Chiang et al. | |
| 6,452,568 | B1 | 9/2002 | Zidek | |
| 6,473,027 | B1 | 10/2002 | Alon | |
| 6,512,487 | B1 | 1/2003 | Taylor et al. | |
| 6,538,604 | B1 * | 3/2003 | Isohatala et al. | 343/700 MS |
| 7,046,209 | B1 | 5/2006 | McCarville et al. | |
| 7,253,770 | B2 | 8/2007 | Yegin et al. | |
| 7,289,078 | B2 | 10/2007 | Navarro | |
| 7,358,920 | B2 | 4/2008 | Apostolos et al. | |
| 7,417,598 | B2 | 8/2008 | Navarro et al. | |
| 7,612,720 | B2 | 11/2009 | Kerselaers | |
| 7,868,830 | B2 | 1/2011 | Worl et al. | |
| 7,884,768 | B2 | 2/2011 | Navarro et al. | |

(Continued)

FOREIGN PATENT DOCUMENTS

WO 02/23669 A1 3/2002

OTHER PUBLICATIONS

Hansen, R.C., "Non-Foster and Connected Planar Arrays," Radio Science, vol. 39, RS4004, doi:10.1029/2004RS003043, 2004, 14 pages.

(Continued)

*Primary Examiner* — Tho G Phan
(74) *Attorney, Agent, or Firm* — Toler Law Group, PC

(57) ABSTRACT

Antenna unit cells suitable for use in antenna arrays are disclosed, as are antenna arrays and mounting platform such as an aircraft comprising antenna unit cells. In one embodiment, an antenna unit cell comprises a signal feed line, a ground plane, a first antenna element comprising a first antenna arm coupled to the signal feed line and a second antenna arm coupled to the ground plane, and a first narrow-band conductor coupled to the first antenna arm and to the ground plane. Other embodiments may be described.

20 Claims, 10 Drawing Sheets

(56) References Cited

U.S. PATENT DOCUMENTS

| | | | | |
|---|---|---|---|---|
| 7,889,135 | B2 | 2/2011 | Blaser et al. | |
| 7,893,867 | B2 | 2/2011 | Navarro | |
| 8,253,633 | B2 * | 8/2012 | Sanz et al. | 343/702 |
| 8,308,072 | B2 | 11/2012 | Satake et al. | |
| 8,643,554 | B1 | 2/2014 | Manry, Jr. et al. | |
| 2003/0043071 | A1 | 3/2003 | Lilly et al. | |
| 2005/0146480 | A1 | 7/2005 | Yazdandoost et al. | |
| 2007/0069968 | A1 | 3/2007 | Moller et al. | |
| 2007/0097006 | A1 | 5/2007 | Brown et al. | |
| 2007/0188398 | A1 | 8/2007 | Mohuchy et al. | |
| 2010/0171675 | A1 | 7/2010 | Borja et al. | |
| 2010/0201578 | A1 | 8/2010 | Parsche | |
| 2010/0330926 | A1 | 12/2010 | Monk | |

OTHER PUBLICATIONS

Holland, S.S. et al., "Design and Fabrication of Low-Cost PUMA Arrays," 2011 IEEE International Symposium on Antennas and Propagation, Jul. 2011, pp. 1976-1979.

Holland, S.S. et al., "The Banyan Tree Antenna Array," IEEE Transactions on Antennas and Propagation, vol. 59, No. 11, Nov. 2011, pp. 4060-4070.

Pozar, D.M. et al., "Scan Blindness in Infinite Phased Arrays of Printed Dipoles," IEEE Transactions on Antennas and Propagation, vol. AP-32, No. 6, Jun. 1984, pp. 602-610.

Schaubert, D.H. et al., "Vivaldi Antenna Arrays for Wide Bandwidth and Electronic Scanning," IEEE The Second European Conference on Antennas and Propagation, 2007, 6 pages.

Final Office Action mailed Apr. 7, 2015, U.S. Appl. No. 13/278,841, 17 pages.

Non-Final Office Action mailed Aug. 6, 2014 in U.S. Appl. No. 13/658,485, 8 pages.

Non-Final Office Action mailed Jan. 3, 2014 in U.S. Appl. No. 13/278,841, 24 pages.

Non-Final Office Action mailed Oct. 2, 2014 in U.S. Appl. No. 13/278,841, 27 pages.

Notice of Allowance and Fee(s) Due mailed Dec. 16, 2014 in U.S. Appl. No. 13/658,485, 7 pages.

Notice of Allowance and Fee(s) Due mailed Mar. 30, 2015 in U.S. Appl. No. 13/658,485, 5 pages.

Restriction Requirement mailed Nov. 7, 2013 in U.S. Appl. No. 13/278,841, 7 pages.

Combined Search and Examination Report, EP13193852; Mar. 4, 2014; 6 pages.

Manny Urcia et al.: "Structurally integrated phased arrays", Aerospace Conference, 2011 IEEE; Mar. 5, 2011; pp. 1-8, XP031937906, D01: 10:1109/AERO.2011.5747321, ISBN: 978-1-4244-7350-2; 8 pages.

* cited by examiner

ULTRA WIDE BAND ANTENNA ELEMENT

RELATED APPLICATIONS

This application is related to commonly assigned U.S. patent application Ser. No. 13/691,309 to Manry filed Nov. 30, 2012, entitled Structural Wideband Multifunctional Apertures, to U.S. patent application Ser. No. 13/278,841 to Manry, et al, filed Oct. 21, 2011 U.S. patent application Ser. No. 13/278,841 to Manry, et al, filed Oct. 21, 2011 and of U.S. patent application Ser. No. 13/115,944 to Manry, et al, filed May 25, 2011, all entitled Ultra Wide Band Antenna Element, the disclosures of which are incorporated herein by reference in their respective entirety.

BACKGROUND

The subject matter described herein relates to electronic communication and sensor systems and specifically to configurations for antenna arrays for use in such systems.

Microwave antennas may be constructed in a variety of configurations for various applications, such as satellite reception, remote sensing or military communication. Printed circuit antennas generally provide antenna structures which are low-cost, lightweight, low-profile and relatively easy to mass produce. Such antennas may be designed in arrays and used for radio frequency systems such as identification of friend/foe (IFF) systems, electronic warfare systems, signals intelligence systems, personal communication service (PCS) systems, satellite communication systems, etc.

Recently, interest has developed in ultra-wide bandwidth (UWB) arrays for use in communication and sensor systems. Thus there is a need for a lightweight phased array antenna with a wide frequency bandwidth and a wide angular scan range and that is conformally mountable to a platform surface.

SUMMARY

In one embodiment, an antenna unit cell comprises a signal feed line, a ground plane, a first antenna element comprising a first antenna arm coupled to the signal feed line and a second antenna arm coupled to the ground plane, and a first narrow-band conductor coupled to the first antenna arm and to the ground plane.

In another embodiment, an antenna array comprises a plurality of unit cells, at least a subset of the unit cells comprising a signal feed line, a ground plane, a first antenna element comprising a first antenna arm coupled to the signal feed line and a second antenna arm coupled to the ground plane, and a first narrow-band conductor coupled to the first antenna arm and to the ground plane.

In another embodiment, an aircraft comprises a communication system and an antenna assembly coupled to the communication system and comprising a plurality of unit cells, at least a subset of the unit cells comprising a signal feed line, a ground plane, a first antenna element comprising a first antenna arm coupled to the signal feed line and a second antenna arm coupled to the ground plane, and a first narrow-band conductor coupled to the first antenna arm and to the ground plane.

Further areas of applicability will become apparent from the description provided herein. It should be understood that the description and specific examples are intended for purposes of illustration only and are not intended to limit the scope of the present disclosure

BRIEF DESCRIPTION OF THE DRAWINGS

Embodiments of methods and systems in accordance with the teachings of the present disclosure are described in detail below with reference to the following drawings.

DETAILED DESCRIPTION

Figure 1:
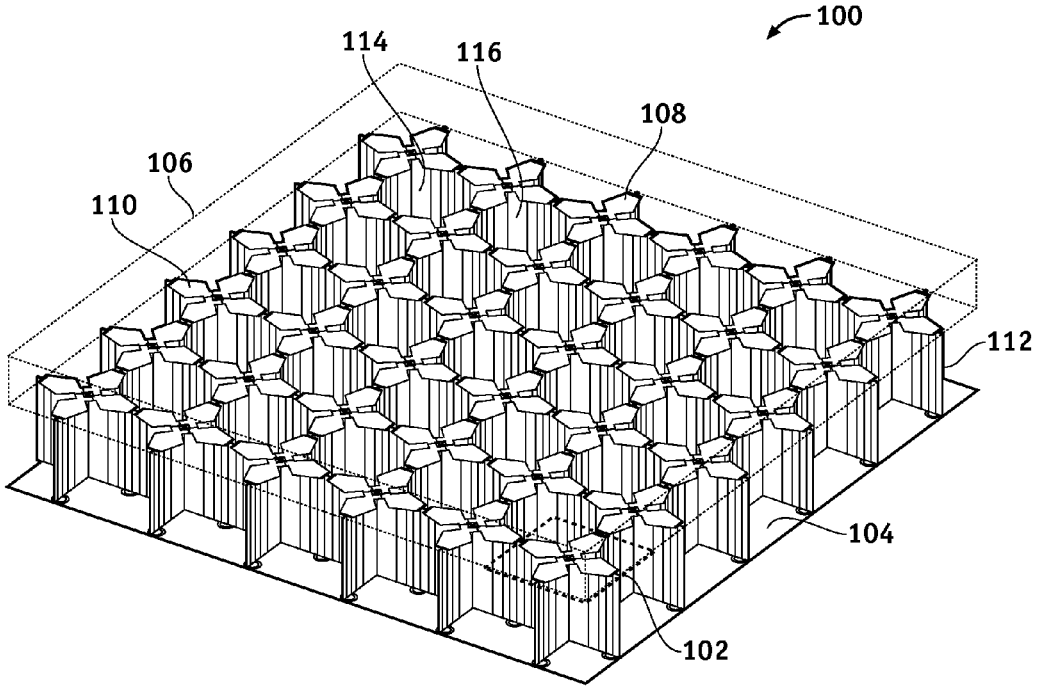
FIGS. 1-2 are illustrations of an antenna array according to an embodiment of the disclosure.

Configurations for antenna unit cells suitable for use in array antenna systems, and antenna systems incorporating such unit cells are described herein. Specific details of certain embodiments are set forth in the following description and the associated figures to provide a thorough understanding of such embodiments. One skilled in the art will understand, however, that alternate embodiments may be practiced without several of the details described in the following description.

The invention may be described herein in terms of functional and/or logical block components and various processing steps. For the sake of brevity, conventional techniques related to electronic warfare, radar, signal intelligence systems, data transmission, signaling, network control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

The following description may refer to components or features being "connected" or "coupled" or "linked" or "bonded" together. As used herein, unless expressly stated otherwise, "connected" means that one component/feature is in direct physically contact with another component/feature. Likewise, unless expressly stated otherwise, "coupled" or "linked" or "bonded" means that one component/feature is directly or indirectly joined to (or directly or indirectly communicates with) another component/feature, and not necessarily directly physically connected. Thus, although the figures may depict example arrangements of elements, additional intervening elements, devices, features, or components may be present in an actual embodiment.

Embodiments of the disclosure are described herein in the context of a non-limiting application, namely, a planar or conformal phased array antenna. Embodiments of the disclosure, however, are not limited to such planar or conformal phased array antenna applications, and the techniques described herein may also be utilized in other applications. For example but without limitation, embodiments may be applicable to manned and unmanned aircraft antennas, sensor antennas, radar antennas, non-conformal antennas, non-planar antennas, and other antenna and phased array applications.

A compact array element with wide bandwidth coverage, wide field of view better than 55 degrees from normal to an antenna face, and polarization diversity is not a capability of current designs. Co-planar broadband-antennas based on Vivaldi type (e.g., a dielectric plate metalized on both sides) antenna elements cannot scan beyond 45 degrees while maintaining their bandwidth, spiral antennas are too large or deep for practical usage, a current sheet antenna based on wire dipoles has demonstrated 9:1 bandwidth coverage but requires the use of feed posts and external RF hybrids. Connected arrays over a ground plane have low efficiency. Spiral based elements do not provide polarization diversity. Other wide band planar elements based on similar concepts require the use of machined feed posts and 180-degree hybrids.

Some antenna structures utilize a twin wire feed network, which may create a null that is in-band, which is referred to as a common-mode null. At the narrow-band frequency where the common-mode null occurs, the antenna array is essentially shorted out. Virtually all planar arrays constructed over a ground plane fed by a twin wire feed exhibit a common-mode null, as do the various classes of CSA type designs including fragmented arrays and variations of Antipodal Vivaldi Antennas.

Efforts have been made in CSA designs and planar dipole/Bow-tie based arrays to eliminate the common-mode null by adding additional shorting posts or pins that are designed to shift the common-mode null out of band. However, the introduction of the additional shorting posts or pins introduces a lower frequency null that limits the bandwidth coverage of the array to no better than a 5:1 ratio. Similarly, additional shorting posts have outside the feed region have been added to Antipodal Vivaldi Antenna (AVA), and the Balanced Antipodal Vivaldi Antenna (BAVA), Mirrored BAVA (DmBAVA). These additional shorting posts also introduce a lower frequency null that limits the bandwidth coverage of the array to a 3.75:1 ratio.

Various embodiments described herein improve bandwidth coverage for wideband RF arrays by incorporating narrow-band conductors to replace a fully conductive shorting post in the array element's feed mechanism. In some embodiments the narrow-band conductors may be formed from metamaterials inspired traces and circuits such as, e.g., connected split ring resonators (SRR) or the like. In some embodiments the use of a metamaterial narrow-band conductor in this manner increases the bandwidth an 8:1 ratio (i.e., the ratio of the highest frequency to the lowest frequency).

Narrow-band conductors as described herein may be employed in a variety of antenna element designs to remove a common-mode null that exists when a simple two wire/post is used to feed the antenna element. In various embodiments described herein narrow-band conductors may be integrated into planar antenna arrays that can be used in creation of wide-band arrays and/or conformal antennas. The wideband arrays and/or conformal antennas can achieve wide bandwidth (e.g., 5:1 ratio or larger), can have an ability to achieve wide scan angles, and can provide both dual and separable RF polarization capability. The antennas have a wide applicability to communication utilizing phased antenna arrays, signal intelligence sensors and detection sensor arrays, wide band radar systems, and phased arrays used in electronics warfare. The antenna element can be used as a shared and/or multifunction RF antenna system. The antenna element can achieve, for example, 5:1 or better bandwidth in both voltage standing wave ratio (VSWR) and gain.

Figure 2:
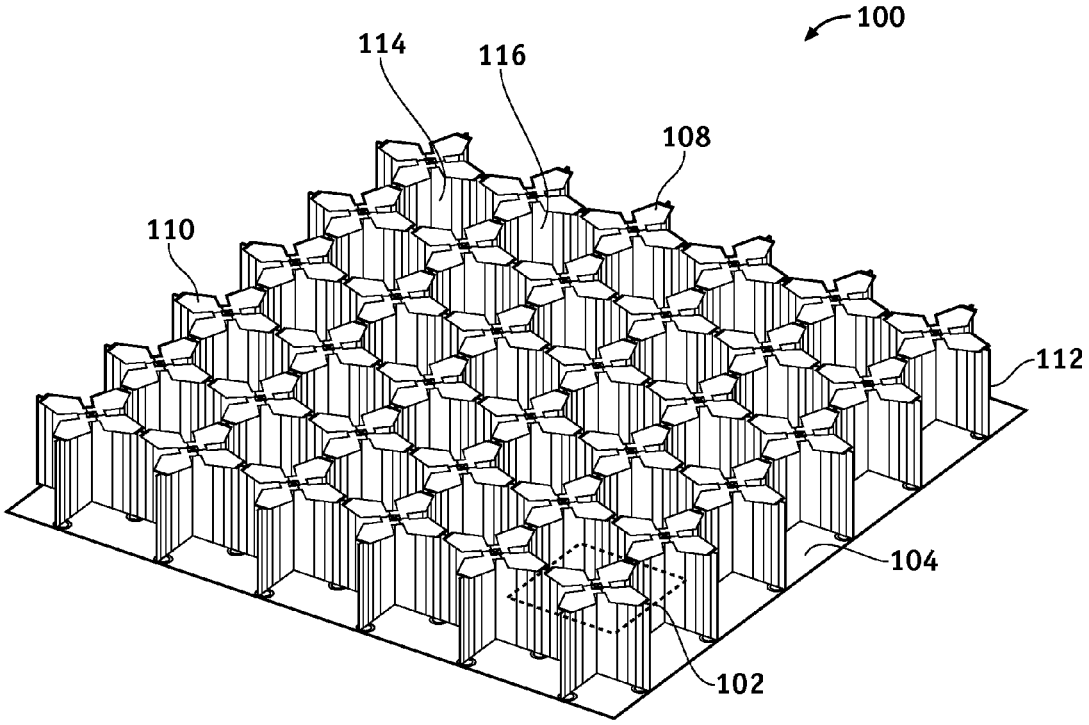

FIG. 1 is an illustration of an exemplary antenna array of unit cells structured in an egg crate configuration according to an embodiment of the disclosure, similar to the structure disclosed in U.S. patent application Ser. No. 13/691,309, incorporated herein by reference above. The structural wideband multifunctional aperture 100 comprises a plurality of unit cells 102 coupled to a ground plane 104 and covered by a dielectric cover 106. FIG. 2 is an illustration of exemplary antenna array shown in FIG. 1 but with the dielectric cover 106 not shown. The unit cells 102 comprise bow-tie antenna elements 108/110 coupled to a structural egg crate circuit board 112. In an alternate embodiment, the exemplary structural wideband multifunctional aperture 100 and unit cell 102 may be comprised of only one set of antenna elements (108 or 110) to form a single polarized aperture.

The dielectric cover 106 may comprise, for example but without limitation, a single layer comprising low electromagnetic loss material, a plurality of layers comprising differing low electromagnetic loss materials, or other configurations.

The structural egg crate circuit board 112 comprises a grid of circuit board planes coupled to the ground plane 104 and is configured perpendicular to the ground plane 104 around a plurality of open boxes 114/116. The structural egg crate circuit board 112 may comprise a low dielectric glass-reinforced epoxy laminate sheets (FR4) or a quartz fabric, which is compatible with high temperature applications, and base materials used in 112 provide a high strength structural integrity capability. Such quartz fabrics may comprise, for example but without limitation, 99.95% $SiO_2$ quartz crystals providing low dielectric loss properties. Astroquartz™ is such a quartz fabric providing low dielectric, near zero coefficient of thermal expansion, high temperature performance and structural mechanical properties in composites.

The open boxes 114/116 may be filled with a low dielectric material comprising, for example but without limitation, a low dielectric foam, an aerogel, a SEAgel, or other low dielectric constant and low loss material. The structural wideband multifunctional aperture 100 can function as a structural sandwich panel as a load-bearing member. For example, the structural wideband multifunctional aperture 100 may comprise an aircraft skin. The structural wideband multifunctional aperture 100 is not limited for integration into an aircraft skin, and skin of other vehicles such as, but without limitation, manned and unmanned ground vehicles, spacecraft, submarines, or other vehicles, may also be used to conform the structural wideband multifunctional aperture 100 thereto.

Figure 11:
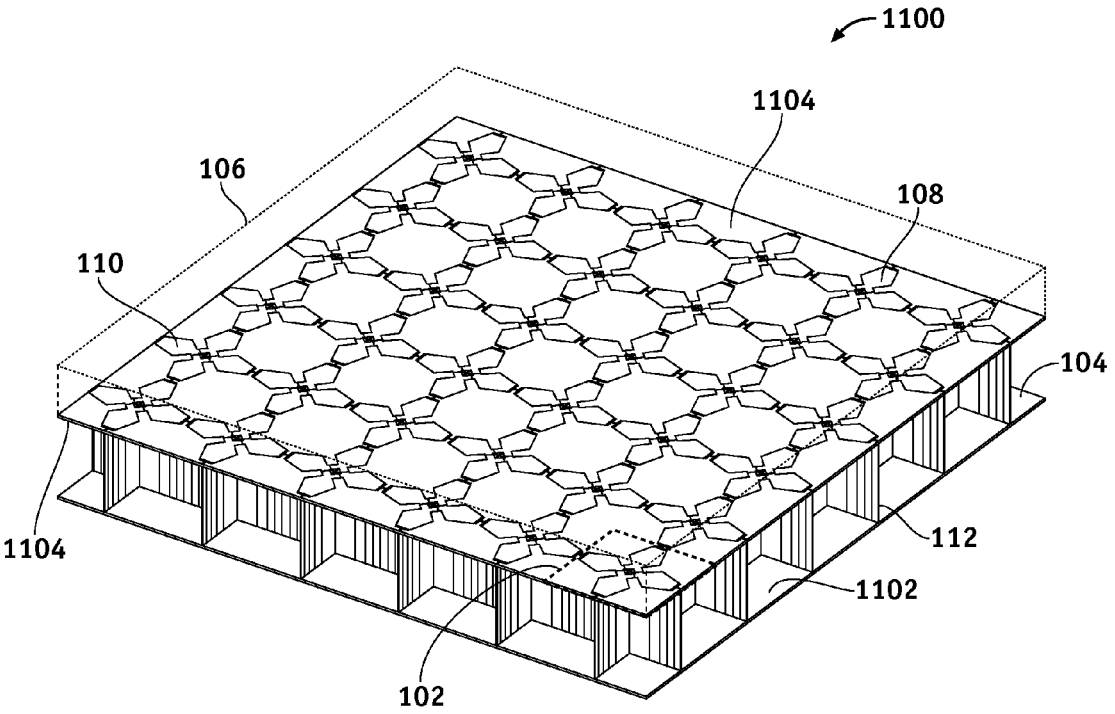
FIG. 11 is an illustration of an exemplary structural wideband multifunctional aperture comprising a sandwich panel configuration, according to embodiments.

The structural wideband multifunctional aperture 100 may be configured as a sandwich panel 100 such as a sandwich panel comprising a structural egg crate circuit board 112 sandwiched between a dielectric cover 106 and/or additional facing sheets and a ground plane 104. The bow-tie antenna elements 108/110, signal feed-lines 312 (FIG. 3), narrow-band conductors 314 (FIG. 3), and grounded shorting-lines 316 (FIG. 3) are to be configured in the sandwich panel 100/1100 (FIG. 11). The dielectric cover 106 incorporates bow-tie antenna elements 108/110, and the structural egg crate circuit board 112 incorporates the signal feed-lines 312, the narrow-band conductors 314, and the grounded shorting-lines 316.

The structural wideband multifunctional aperture 100 (sandwich panel 100) may be integrated into a structure of a vehicle such as an aircraft. For example, the structural wide-band multifunctional aperture 100 may be integrated into an outer composite skin of the aircraft. Furthermore, electronics can be attached to a backside behind the ground plane 104. The structural wideband multifunctional aperture 100 is configured to function under a structural loading of the aircraft. Furthermore, the bow-tie antenna elements 108/110, the signal feed-lines 312, the narrow-band conductors 314, the grounded shorting-lines 316, and other interconnects, connections, and electronics are configured to function under a structural loading of the aircraft.

FIG. 2 is an illustration of the structural wideband multifunctional aperture 100 of FIG. 1 with the dielectric cover 106 removed. The structural wideband multifunctional aperture 100 may target, for example, a lower frequency wideband element. The bow-tie antenna elements 108/110 allow for an egg-crate configuration such as the structural egg crate circuit board 112 that enables an array of the structural wideband multifunctional aperture 100 to be designed and built to carry structural loads. The structural wideband multifunctional aperture 100 allows for a wide band array that is thin and light as well. There is more flexibility with a location of the structural wideband multifunctional aperture 100 on a platform such as an aircraft and a size of the structural wideband multifunctional aperture 100 has a potential to be as large as the structure is the aircraft. The ability of the structural wide-band multifunctional aperture 100 to carry structural loads while providing wide bandwidth allows the aperture to be installed in small and medium UAV's adding to their mission capabilities they would otherwise not have.

Figure 3:
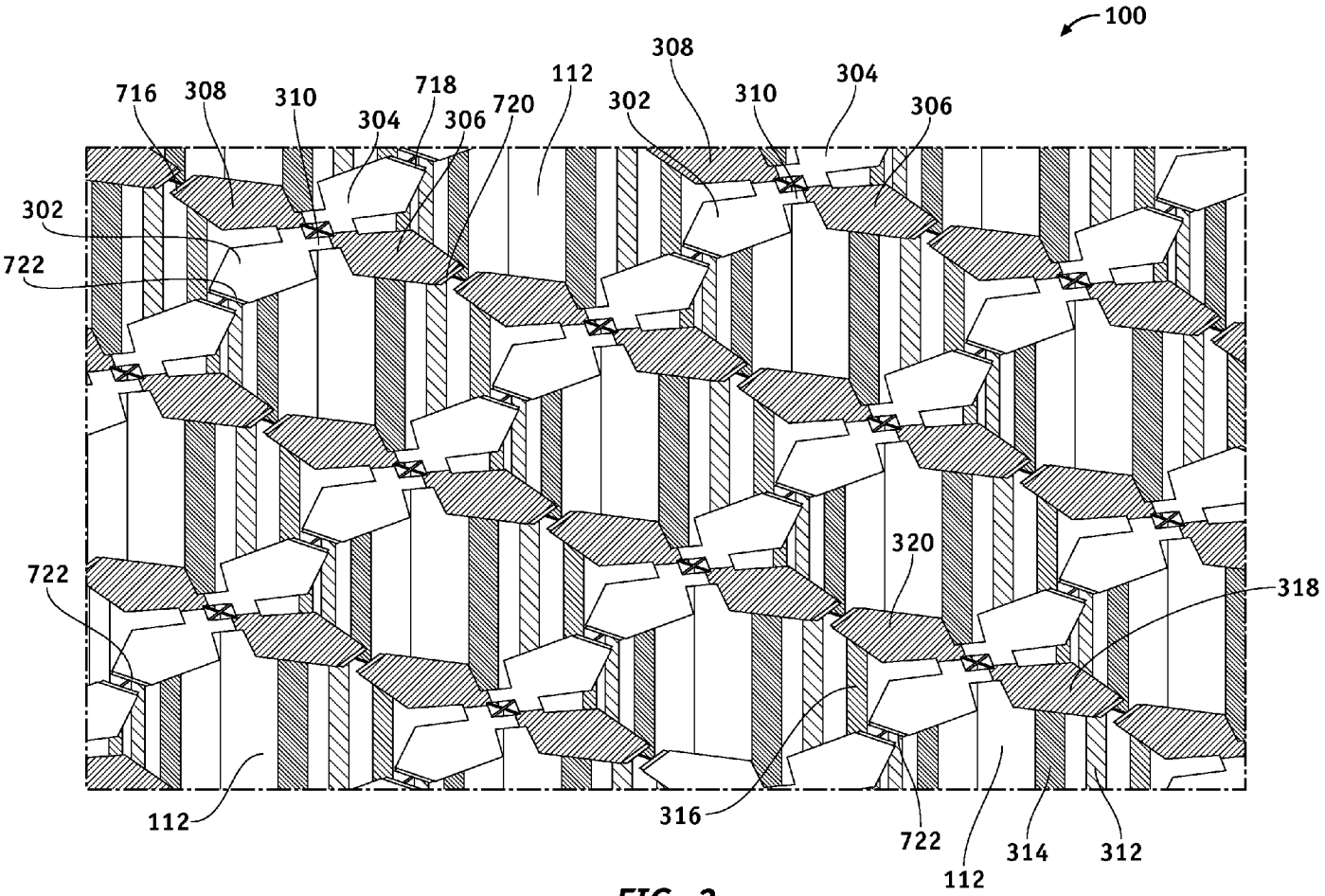
FIG. 3 is an illustration of an expanded view of the structural wideband multifunctional aperture of FIG. 2.

FIG. 3 is an illustration of an expanded view of the structural wideband multifunctional aperture 100 of FIG. 2. A first bow-tie antenna element 302/304 comprises a driven bow-tie arm 302 and a ground shorted bow-tie arm 304. The driven bow-tie arm 302 and the grounded bow-tie arm 304 may function as dipole antennas. A second bow-tie antenna element 306/308 comprises a driven bow-tie arm 306 and a grounded bow-tie arm 308. The first bow-tie antenna element 302/304 and the second bow-tie antenna element 306/308 may overlap at an overlap region 310. The overlap region 310 may provide capacitive coupling between the first bow-tie antenna element 302/304 and the second bow-tie antenna element 306/308.

Figure 4:
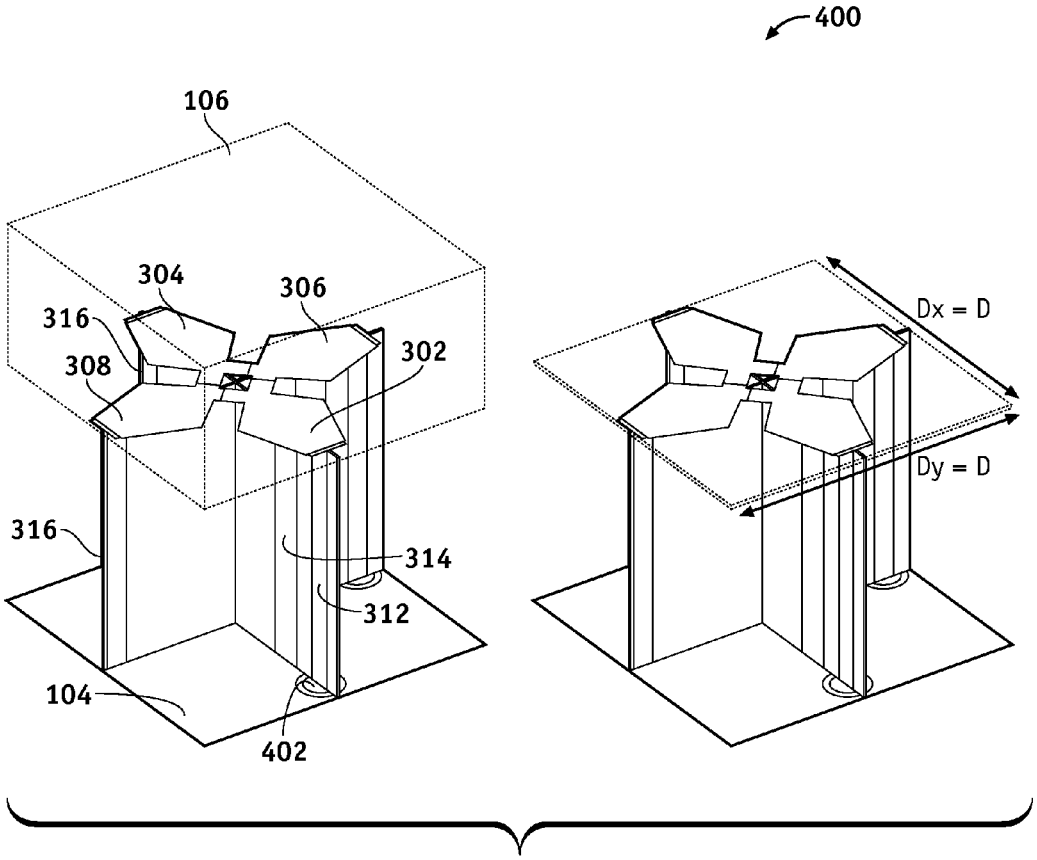
FIG. 4 is a perspective view illustration of an exemplary antenna unit cell according to an embodiment of the disclosure.
Figure 5:
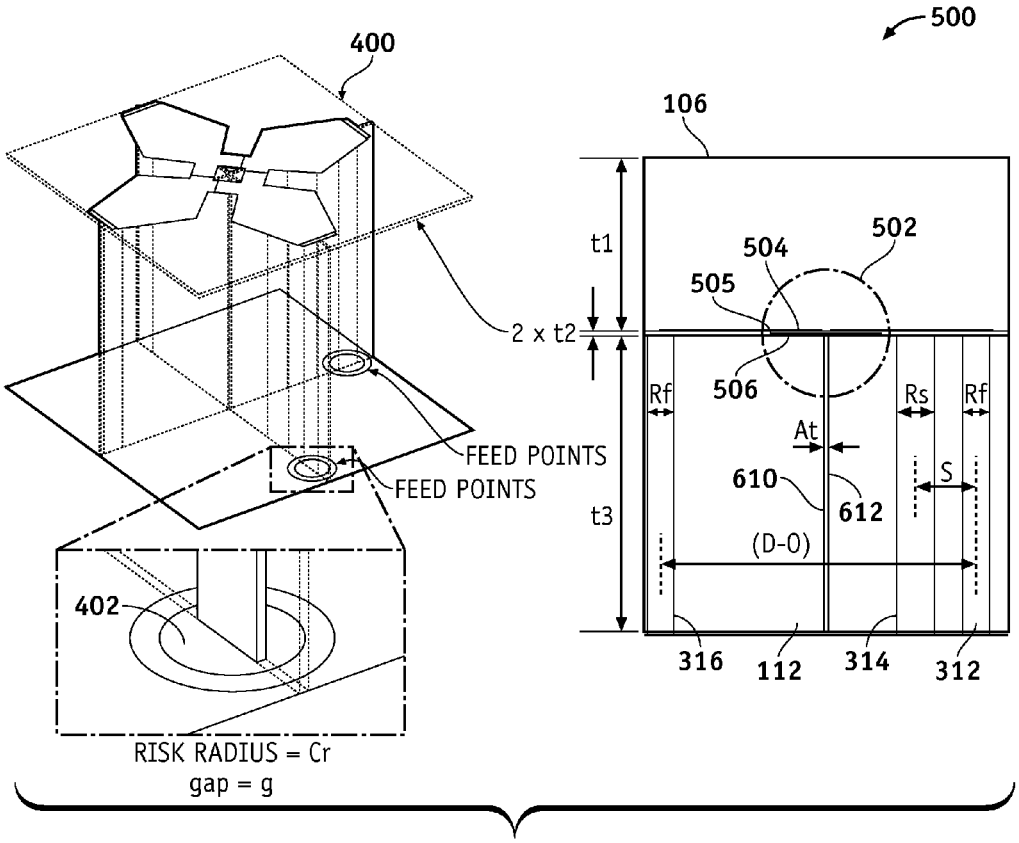
FIG. 5 is a cross section view illustration of an exemplary unit cell in relation to a unit cell according to an embodiment of the disclosure.
Figure 6:
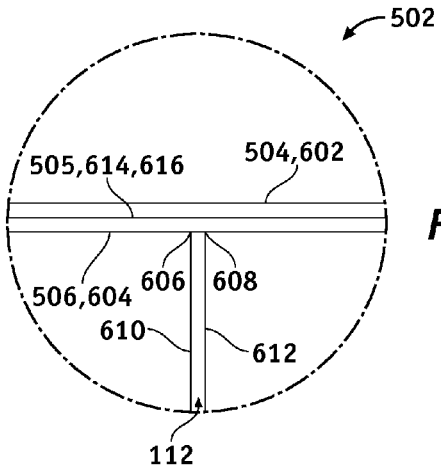
FIG. 6 is an illustration of an expanded view of a cross section of the antenna layer, combined antenna/feed layer, and the feed layer of FIG. 5 according to an embodiment of the disclosure.
Figure 7:
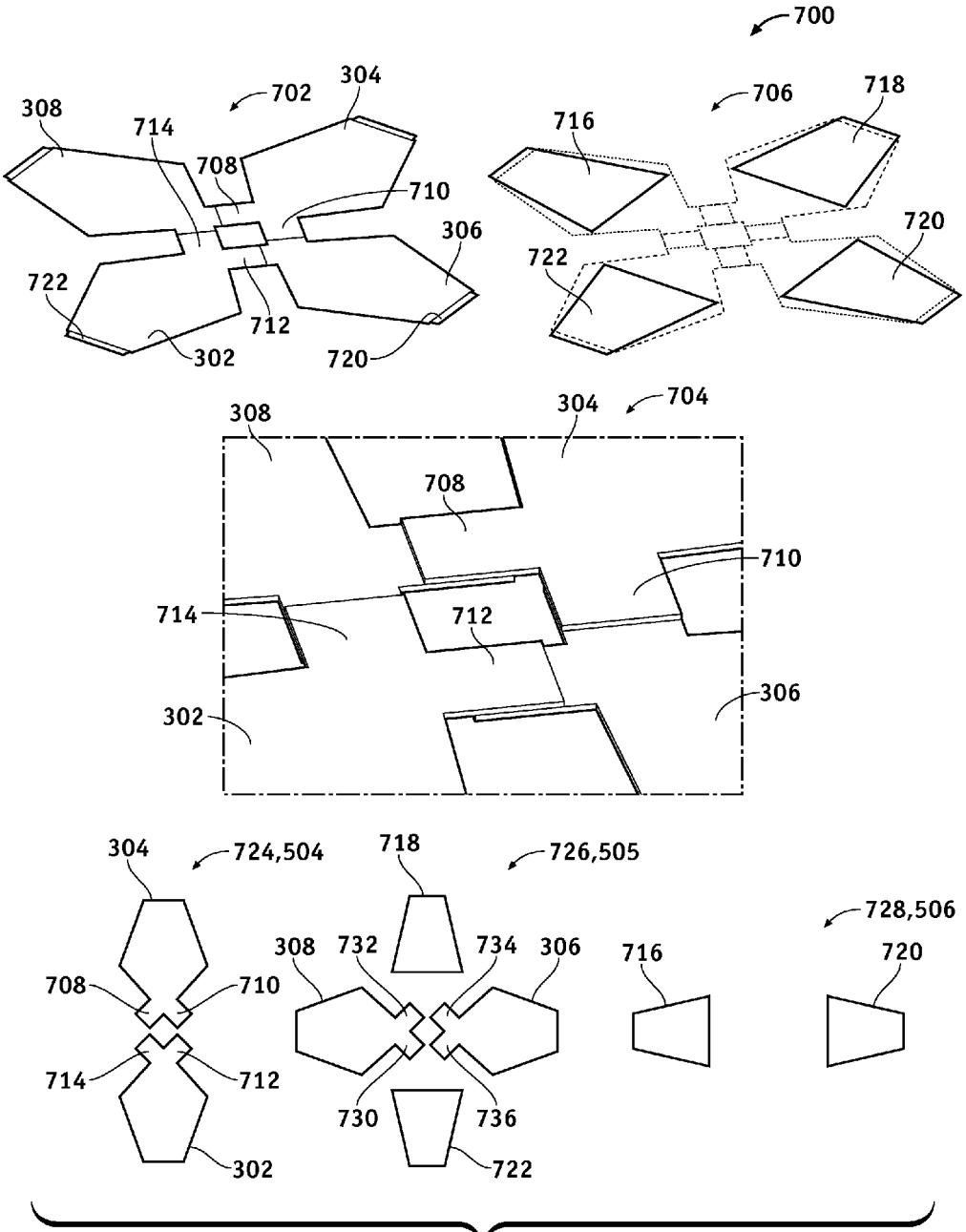
FIG. 7 is an illustration of an exemplary antenna assembly comprising feed layer and antenna layer elements according to an embodiment of the disclosure.

Referring for this paragraph to FIGS. 3-7, the first bow-tie antenna element 302/304 and the second bow-tie antenna element 306/308 are driven by signal feed-line 312 and narrow-band conductor 314 and grounded shorting line 316 coupled to the structural egg crate circuit board 112. For example, a driven bow-tie antenna arm 302 in an antenna layer 504 (FIGS. 5, 6, 7) is electromagnetically coupled to (and may be driven by) a bow-tie antenna feed layer element 722 (FIGS. 3, 7) in a combined antenna/feed layer 505 (FIGS. 5, 6, 7) coupled to a drive/feed-line 312 coupled to a signal transmission line 402 (FIG. 4). The bow-tie antenna feed layer element 722 may be further coupled to a narrow-band conductor 314 coupled to the ground plane 104 grounding the bow-tie antenna feed layer element 722. A ground shorted bow-tie antenna arm 304 in antenna layer 504 is electromagnetically coupled to a bow-tie antenna feed layer element 718 (FIGS. 3, 7) in the combined antenna/feed layer 505 (FIGS. 5, 6, 7). The bow-tie antenna feed layer element 718 is coupled to a grounded shorting-line 316 coupled to the ground plane 104 grounding the bow-tie antenna feed layer element 718. Similarly, a driven bow-tie arm antenna element 306 in the combined antenna/feed layer 505 is electromagnetically coupled to (and may be driven by) a bow-tie antenna feed layer element 720 (FIG. 7) in a feed layer 506 (FIGS. 5, 6, 7). Also, a ground shorted bow-tie antenna arm 308 in the combined antenna/feed layer 505 is electromagnetically coupled to a bow-tie antenna feed layer element 716 (FIG. 7) in the feed layer 506.

The terms antenna layer, antenna layer element, bow-tie antenna element, bow-tie antenna arm, bow-tie arm antenna element, and the like may be used interchangeably in this document. Also, the terms feed layer, feed layer element, bow-tie feed layer element, bow-tie feed layer arm, bow-tie arm feed layer element, and the like may be used interchangeably in this document.

The structural wideband multifunctional aperture 100 comprises the bow-tie antenna elements 108/110 in an egg-crate configuration comprising capacitive bow-tie or dipole-like feeds either underneath a set of capacitively linked bow-tie or dipole-like arms such as the driven bow-tie arm 302. The feed layer 506 and the driven bow-tie arm 318 can be interchanged to create different configurations. Two elements on the feed layer 506 are connected to an RF source or receiver via the feed-line 312 that can be directly connected to an RF connector to provide, for example, about 3:1 or better bandwidth. The feed-line 312 can also be connected by capacitive coupling to a Z-transformer stripline to provide wider bandwidth by adding two additional layers below the structural wideband multifunctional aperture 100. The addition of the Z-transformer stripline provides an ability to achieve, for example, about 5:1 or better bandwidth. Shorting traces such as the narrow-band conductors 314 and grounded shorting-lines 316 are added in tune the overall structural wideband multifunctional aperture 100 to avoid in-band resonances causing nulls in RF performance.

FIG. 4 is an illustration of an exemplary unit cell 400 (e.g., unit cell 102 of the structural wideband multifunctional aperture 100 in FIG. 1) according to an embodiment of the disclosure. The unit cell 400 comprises a dimension Dx in an X direction and a dimension Dy in a Y direction. The unit cell 400 may be symmetric, wherein the dimension Dx and the dimension Dy equal a same length D comprising, for example but without limitation, about 24.5 mm, or other suitable length. In other embodiments, the dimension Dx and the dimension Dy may comprise dissimilar values. The bow-tie antenna elements 108 of the structural wideband multifunctional aperture 100 may comprise the first bow-tie antenna element 302/304, and the bow-tie antenna elements 110 of the structural wideband multifunctional aperture 100 may comprise the second bow-tie antenna element 306/308.

The structural wideband multifunctional aperture 100 comprises the bow-tie antenna elements 108/110 with wide bandwidth and better than, for example, about 50-degree conical scan volume that can be used for creation of conformal arrays and antennas. The structural wideband multifunctional aperture 100 provides effective gain within, for example, about 2 to 3 dB of an ideal gain possible for a surface area of a unit-cell for an antenna element. The structural wideband multifunctional aperture 100 can be used as a wide-band antenna and/or array. The structural wideband multifunctional aperture 100 can be used in multifunction and/or shared antenna configuration for communications, electronic warfare, and signal intelligence applications and multiple combinations of multiple applications. The structural wideband multifunctional aperture 100 not only provides wide-bandwidth coverage it also provides polarization diversity to allow the transmission and reception of signals with any arbitrary polarization that comprises, for example but without limitation linear, circular, slant polarized signals, and other polarization signal. The structural wideband multifunctional aperture 100 can be scaled to any frequency band with a matching bandwidth ratio (e.g. about, 5:1) from the highest to the lowest frequency of a desired coverage.

FIG. 5 is an illustration of an exemplary cross section 500 of the unit cell 400 in FIG. 4 according to an embodiment of the disclosure. As shown in the cross section 500, a depth t1 of the dielectric cover 106 may comprise, for example but without limitation, about 10 mm, or other suitable thickness. A height t3 of the structural egg crate circuit board 112 may comprise, for example but without limitation, about 14 mm, or other suitable height. A thickness of t2 between the antenna layer 504, and the combined antenna/feed layer 505, and also between the combined antenna/feed layer 505 and the feed layer 506, may comprise, for example but without limitation, about 0.13 mm (5 mils), or other suitable thickness. The circuit board materials used to form the layers 504, 505 and layer 506 may comprise, for example but without limitation, Rogers 6002™ or other circuit board materials. A width Rf of the drive-line 312, a width Rs of the narrow-band conductor 314, and a width Rf of the grounded shorting-line 316 may comprise, for example but without limitation, about 1 mm each, or other suitable width.

A spacing S between the drive feed-line 312 and the narrow-band conductor 314 may comprise, for example but without limitation, about 4.1 mm, or other suitable spacing. In an alternate embodiment the narrow-band conductor 314 can be replaced by multiple parallel traces with varying widths. Similarly but without limitation the narrow-band conductor 314 can have multiple narrow-band, or multi-band, or other tuned frequency responses used to eliminate in-band antenna nulls and may be used to tune the overall antenna structure 100. Similarly but without limitation one or more narrow-band traces may be placed adjacent to grounded shorting-line 316 with a designed spacing similar to the spacing S between drive-line 312 and the narrow-band feature 314.

A risk radius Cr and a gap g of the signal transmission line 402 may comprise, for example but without limitation, about 1.3 mm and 0.5 mm respectively, or other suitable radius and gap. A distance D-O between the drive feed-line 312 and the grounded shorting-line 316 may comprise, for example but without limitation, about 10 mm, or other suitable distance.

Integration of the structural wideband multifunctional aperture 100 into a structure provides a significant advancement of aperture technologies over traditional apertures as traditional apertures are rigid/non-load bearing members and they are not allowed to flex. This limits the size and locations of traditional apertures onto a vehicle such as an aircraft. Integrating the structural wideband multifunctional aperture 100 into a structure such as an aircraft structure: allows 1) a larger size aperture as the aperture comprise the structure of the aircraft, 2) for more flexibility of the location of the aperture on the aircraft structure, and 3) the aperture to be installed in small and medium UAV's adding to their mission capabilities.

FIG. 6 is an illustration of an expanded view of a cross section of the antenna layer 504, the combined antenna/feed layer 505, and the feed layer 506 of FIG. 5 according to an embodiment of the disclosure. The antenna layer 504 may comprise an antenna element 602 such as the driven bow-tie arm 302 and the grounded bow-tie arm 304. The combined antenna/feed layer 505 may comprise an antenna element 614 such as the driven bow-tie arm antenna element 306 and the grounded bow-tie arm 308, and/or a feed element 616 such as the bow-tie antenna feed layer elements 718 and 722 (FIGS. 3, 7). The feed layer 506 may comprise a feed element 604 such as the bow-tie antenna feed layer elements 716 and 720 (FIG. 3, 7).

The antenna element 602 of the antenna layer 504 is electromagnetically coupled to the feed element 616 of the combined antenna/feed layer 505. The antenna element 614 of the combined antenna/feed layer 505 is electromagnetically coupled to the feed element 604 of the feed layer 506. The feed elements 604 and 616 are coupled to the feed-line 312, the narrow-band conductors 314 and/or the grounded shorting-line 316 coupled to the structural egg crate circuit board 112 (FIG. 1). The feed-line 312, the narrow-band conductor 314 and the grounded shorting-line 316 may each comprise a first side lead 610 coupled to a first side of the structural egg crate circuit board 112, a second side lead 612 coupled to a second side of the structural egg crate circuit board 112, or both the first side lead 610 and the second side lead 612 coupled to the structural egg crate circuit board 112.

The first side lead 610 and the second side lead 612 are coupled to the structural egg crate circuit board 112 by a first joint 606 and a second joint 608 respectively. The first joint 606 and the second joint 608 may comprise, for example but without limitation, a weld, a diffusion bond, a solder, or suitable other coupling. A width At of the structural egg crate circuit board 112 and also a spacing At between the first side lead 610 and the second side lead 612 may comprise, for example but without limitation, about 0.1 mm, or other suitable width or spacing.

FIG. 7 is an illustration of an exemplary antenna assembly 700 comprising feed layer and antenna layer elements according to an embodiment of the disclosure. An antenna assembly 702 may comprise an antenna layer such as the antenna layer 504 comprising the antenna elements 302, 304, 306 and 308 overlaying the feed layer elements 722, 718, 720 and 716 respectively. A bow-tie antenna element 302/304 comprises the antenna arm element 302 comprising an overlap leaf 712 and an overlap leaf 714, and the antenna arm element 304 comprising an overlap leaf 708 and an overlap leaf 710. A bow-tie antenna element 306/308 comprises the antenna element 306 comprising an overlap leaf 734 and an overlap leaf 736, and the antenna element 308 comprising an overlap leaf 732 and an overlap leaf 734. The bow-tie antenna element 302/304 is configured in a first layer (Layer 1: 724) along a Y-Axis (not shown), and the bow-tie antenna element 306/308 is configured in a second layer (Layer 2: 726) along an X-Axis (not shown).

The bow-tie antenna element 302/304 is electromagnetically coupled to the feed layer element 722/718, and the bow-tie antenna element 306/308 is electromagnetically coupled to the feed layer element 720/716 (Layer 3: 728).

The overlap leaf 708 overlays and is capacitively coupled to the overlap leaf 732. The overlap leaf 710 overlays and is capacitively coupled to the overlap leaf 734. The overlap leaf 712 overlays and is capacitively coupled to the overlap leaf 736. The overlap leaf 714 overlays and is capacitively coupled to the overlap leaf 730.

The antenna elements 302, 304, 306 and 308 may be capacitively coupled in an overlap area 704. The antenna arm element 302 is capacitively coupled to the antenna arm element 304 by the overlap leafs 708-712 and 730-736. The antenna element 306 is capacitively coupled to the antenna element 308 by the overlap leafs 708-712 and 730-736.

In some embodiments, the Y-axis layer (Layer 1: 724) and the X-axis layer (Layer 2: 726) may have different parameters and/or resemble other bow-tie or dipole shapes. In some embodiments, the antenna assembly 702/700 can be single polarized comprising of only one set of antenna arms and feeds such as one of the bow-tie antenna element 302/304 and the bow-tie antenna element 306/308. Selections of materials and number of layers, for a circuit card and materials below and above an antenna circuit board are also part of the design. Embodiments of disclosure provide a means for use of a 3 layer combined antenna design with the structural egg crate circuit board 112 (FIG. 1). An important feature is the use of a 3 layer antenna board design that allows the structural wideband multifunctional aperture 100 to be configured in an egg-crate layout such as the structural egg crate circuit board 112. Addition of bow-tie or dipole shapes on layers 2 (726) and 3 (728) to capacitively feed the end cross-element configuration dual polarized elements on layers 1 (724) and 2 (726) allows for the egg crate layout.

Figure 8:
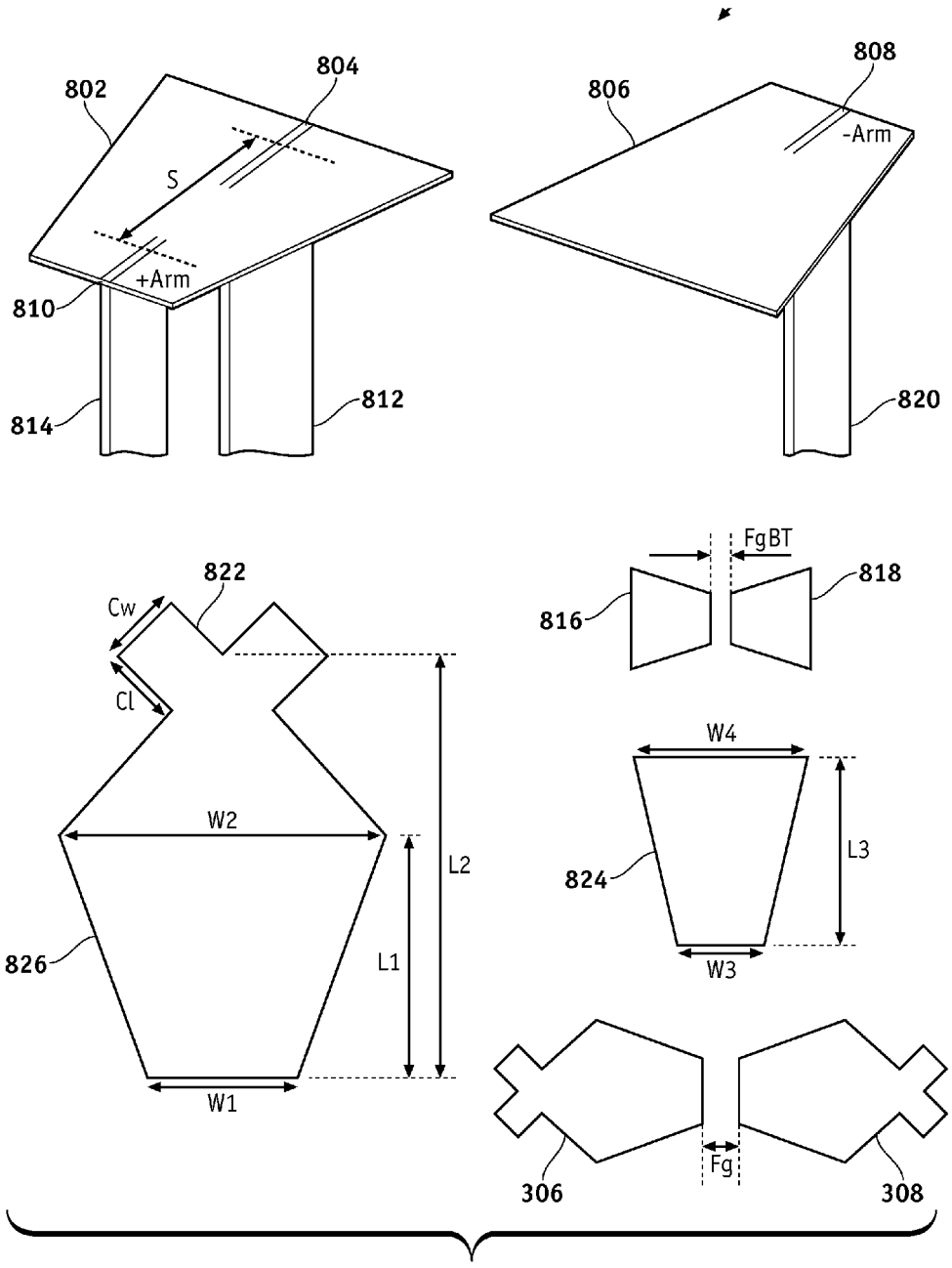
FIG. 8 is an illustration of exemplary feed layer element dimensions and antenna layer element dimensions according to an embodiment of the disclosure.

FIG. 8 is an illustration of exemplary feed layer element dimensions and antenna layer element dimensions according to an embodiment of the disclosure. A feed layer element 802 may comprise a driven feed layer element such as the feed layer elements 720 and 722 (FIGS. 3, 7). A feed layer element 806 may comprise a ground shorted feed layer element such as the feed layer elements 716 and 718 (FIGS. 3, 7). An antenna layer element 826 may comprise a driven bow-tie antenna layer element such as the driven bow-tie arm antenna layer element 302 and 306 (FIGS. 3, 7) or the grounded bow-tie arm antenna layer element 304 and 308 (FIGS. 3, 7). Representative parameters for, for example but without limitation, a 1.2 GHz to 6 GHz design are described below.

The feed layer element 802 is coupled to a feed line 814 (e.g., 312 in FIGS. 3, 5, 12) at a joint 810 and a narrow-band conductor 812 (e.g., 314 in FIGS. 3, 5, 12) at a joint 804. The spacing S between the feed line 814 and the narrow-band conductor 812 may comprise, for example but without limitation, about 4.1 mm, or other suitable spacing. The feed layer element 806 is coupled to a grounded shorting-line 820 (e.g., 316 in FIGS. 3, 5, 12). A gap between adjacent feed layer elements FgBT such as between a feed layer element 816 and a feed layer element 818 may comprise, for example but without limitation, about 2 mm, or other suitable gap. A feed layer 824 may comprise, for example but without limitation, a length L3 of about 6.5 mm, an outer width W3 of about 3 mm, an inner width W3 of about 6 mm, or other suitable dimensions.

The antenna layer element 826 may comprise, for example but without limitation, a length-to-maximum-width L1 of about 5.6 mm, a length L2 of about 9.8 mm, an end width W1 of about 3.5 mm, a maximum-width W2 of about 7.5 mm, or other suitable dimensions. An antenna overlap leaf 822 may comprise, for example but without limitation, a leaf length Cl of about 1.7 mm, a leaf width Cw of about 1.75 mm, or other suitable dimensions. An adjacent antenna element gap Fg between adjacent antenna elements such as between the driven bow-tie arm antenna element 306 of a first unit cell and the grounded bow-tie arm antenna element 308 of a second unit cell may comprise, for example but without limitation, about 1.5 mm, or other suitable gap.

Figure 9:
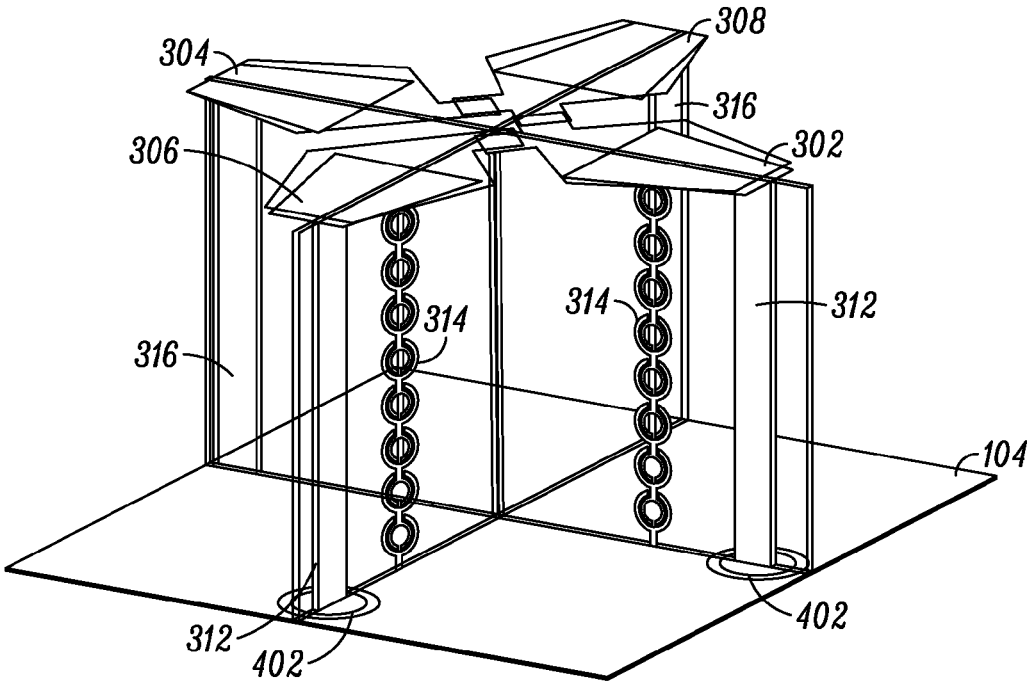
FIG. 9 is a schematic perspective of an antenna unit cell, according to embodiments.

FIG. 9 is a schematic perspective of an antenna unit cell, according to embodiments. The unit cell 400 depicted in FIG. 9 is substantially similar to the unit cell 400 depicted in FIGS. 4-5, but the narrow-band conductors 314 are shown with greater clarity. Referring to FIG. 9, an antenna unit cell 400 comprises a ground plane 104 and signal feed lines 312 which are coupled to a signal transmission lines 402. Unit cell 400 comprises a first antenna element comprising a first antenna arm 302 coupled to the signal feed line 312 and a second antenna arm 304 coupled to the ground plane 104 by a grounded shorting line 316. A first narrow-band conductor 314 is coupled to the first antenna arm 302 and to the ground plane 104. Unit cell 400 further comprises a second antenna element comprising a third antenna arm 306 coupled to the signal feed line and a fourth antenna arm 308 coupled to the ground plane 104 by a grounded shorting line 316. A second narrow-band conductor 314 is coupled to the first antenna arm 306 and to the ground plane 104. The antenna arms 302, 304, 306, 308 are disposed in planes which are substantially parallel to the ground plane 104.

Figure 10:
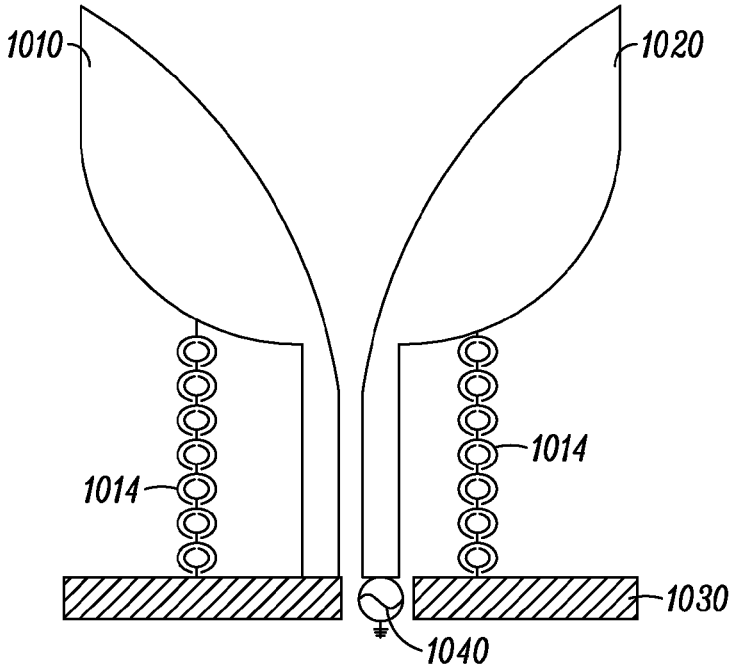
FIG. 10 is a schematic side elevation view of an antenna unit cell, according to embodiments.

As described above, in some embodiments the narrow-band conductors 314 may be implemented using metamaterial inspired traces. In the embodiment depicted in FIG. 9 the antenna unit cell 400 may be operative within a frequency range between a first frequency and a second frequency and the narrow-band conductors 314 are implemented using a set of connected split ring resonators which may be tuned to be conductive only within a predetermined frequency band between the first frequency and the second frequency. By way of example, the narrow-band conductors 314 may be tuned to be conductive within a frequency band which corresponds to the common-mode null of the antenna element 400. FIG. 10 is a schematic side elevation view of an alternate embodiment of an antenna unit cell, according to embodiments. The antenna unit cell 1000 depicted in FIG. 10 may be embodied as a Banyan Tree Antenna (BTA) as described in The Banyan Tree Antenna Array by Steven S. Holland and Marinos N. Vouvakis, IEEE Transactions on Antennas and Propagation, Vol. 59, No. 11, November 2011, the disclosure of which is incorporated herein by reference in its entirety.

Referring to FIG. 10, antenna unit cell 1000 comprises two exponentially tapered antenna elements 1010, 1020 with inner and outer flare rates of Ri and Ro, respectively. Antenna elements 1010 and 1020 are oriented vertically over a ground plane 1030. Antenna element 1020 is coupled to a signal feed line 1040 and antenna element 1010 is coupled to ground plane 1030. The antenna elements 1010, 1020 may be formed from a single metal layer which may be embedded between two dielectric sheets. In an alternate embodiment an antenna unit cell can be configured to produce a dual polarized array by adding a 90-degree rotated version of 1000, as been demonstrated in other Antipodal Vivaldi Antenna (AVA, DAVA, and DmBAVA) dual polarized configurations.

In some embodiments a narrow-band conductor 1014 is coupled to at least one of the antenna elements 1010, 1020 and to the ground plane 1040. In the embodiment depicted in FIG. 10 both elements 1010, 1020 are coupled to the ground plane 1030 by a narrow-band conductor 1014. One skilled in the art will recognize that in alternate embodiments only a single antenna element 1010 or 1020 may be coupled to the ground plane 1030 by a narrow-band conductor 1014.

As described above, in some embodiments the narrow-band conductors 314 may be implemented using metamaterial inspired traces. In the embodiment depicted in FIG. 10 the antenna unit cell 1000 may be operative within a frequency range between a first frequency and a second frequency and the narrow-band conductors 1014 are implemented using connected split ring resonators which may be tuned to be conductive only within a predetermined frequency band between the first frequency and the second frequency. By way of example, the narrow-band conductors 1014 may be tuned to be conductive within a frequency band which corresponds to the common-mode null of the antenna element 1000.

One skilled in the art will recognize that a narrow-band, multiband, or tuned response function in narrow-band conductor feature 314/1014 can be achieved by a number of various shapes and configurations, including but without limitation a variety of printed shapes and features, passive circuit components, and active circuit components. In an alternate embodiment lumped circuit components can be used alone or in combination with solid and/or patterned traces to create the RF response desired in the narrow-band conductor feature 314/1014. In an alternate embodiment passive switched or switching components can be used along or in conduction with solid and/or patterned traces to create a switched or active/adaptive tuning response for the feature 314/1014. In an alternate embodiment active electronics and switches can be used along or in conduction with solid and/or patterned traces to create a switched or active/adaptive tuning response for the feature 314/1014. In an alternate embodiment Non-Fosters circuits, or negative impedance devices, can be used along or in conduction with solid and/or patterned traces to create a tuning response for the feature 314/1014.

One skilled in the art will recognize that all the antenna patterns, feeds, and traces described herein can be fabricated for example but without limitation by using etched patterns, direct-write and spray techniques, electrodeposition, and patterns and shapes placed on thin film materials and then bonded to the bulk materials used in the exemplary unit cell 400/1000 and in the overall assembly of 100.

FIG. 11 is an illustration of an exemplary structural wideband multifunctional aperture comprising a sandwich panel configuration 1100 (sandwich panel 1100) according to an embodiment of the disclosure. The structural wideband multifunctional aperture 100 may be configured in the sandwich panel 1100 comprising the structural egg crate circuit board 112 sandwiched between one or more facing sheet 1104 and one or more backing sheet 1102. The facing sheet 1104 and the backing sheet 1102 may provide additional stiffness to the structural egg crate circuit board 112. The facing sheet 1104 and the backing sheet 1102 may each comprise, for example but without limitation, a low dielectric quartz fabric or other low dielectric material. For example, the low dielectric quartz fabric may be compatible with high temperature and provides high strength structural integrity. Such quartz fabrics may comprise, for example but without limitation, 99.95% SiO2 quartz crystals providing low dielectric loss properties.

Figure 12:
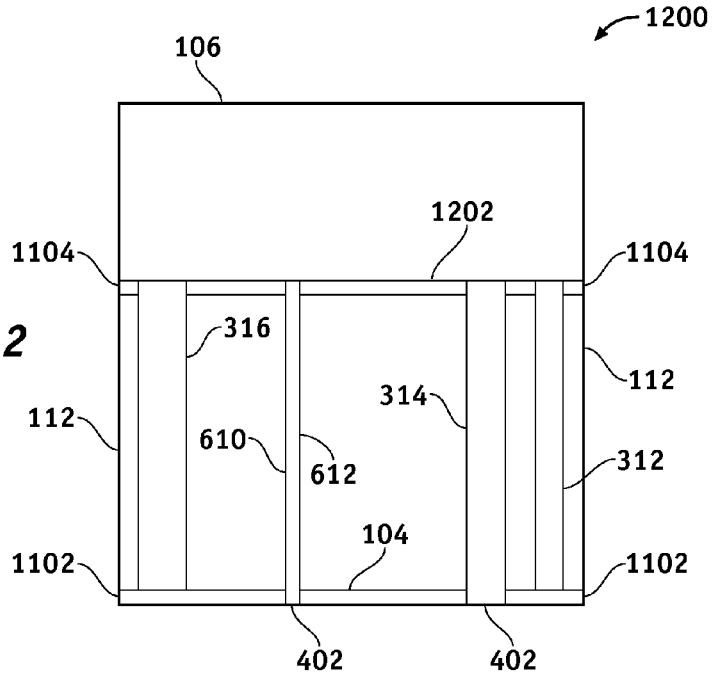
FIG. 12 is an illustration of an expanded view of the sandwich panel configuration of FIG. 11.
Figure 13:
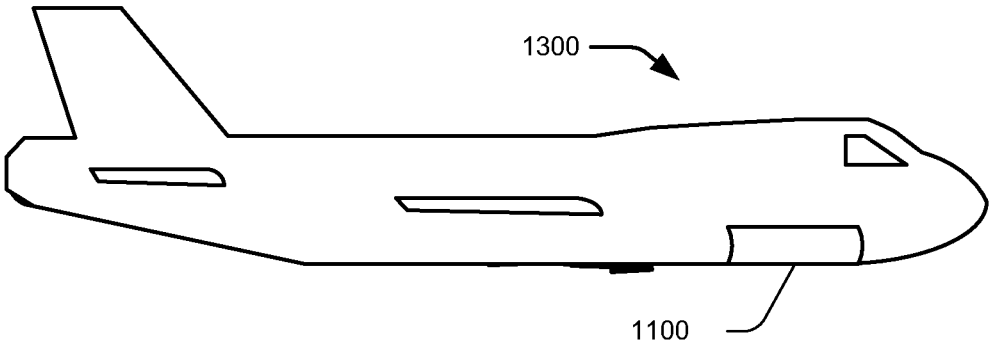
FIG. 13 is a schematic illustration of an aircraft, according to embodiments.

FIG. 12 is an illustration of an expanded view 1200 of the sandwich panel configuration 1100 of FIG. 11. The antenna elements 108/110 (antenna layer) in the antenna layer 504 and the combined antenna/feed layer 505, the feed layer 506 are configured in a plane 1202 above the facing sheet 1104. The ground plane 104 may be configured above or below the backing sheet 1102. Furthermore, electronics can be attached below the backing sheet 1102 and the ground plane 104. The antenna elements 108/110, signal feed-lines 312, grounded shorting-lines 314, and grounded shorting-lines 316 are to be configured in the sandwich panel 1100. The dielectric cover 106 covers the bow-tie antenna elements 108/110, and the structural egg crate circuit board 112 incorporates the signal feed-lines 312, the grounded shorting-lines 314, and the grounded shorting-lines 316.

The sandwich panel 1100 may be integrated into a structure of a vehicle such as an aircraft 1200 (FIG. 12). For example, the sandwich panel 1100 may be integrated into an outer composite skin of an aircraft 1200. The structural wideband multifunctional aperture 100 is configured to function under a structural loading of the aircraft. Furthermore, the antenna elements 108/110, the signal feed-lines 312, the narrow-band conductors 314, the grounded shorting-lines 316, and other interconnects, connections, and electronics are configured to function under a structural loading of the aircraft. In alternate embodiments a sandwich panel 1100 may be mounted on a ground-based vehicle such as a truck, tank, train, or the like, or on a water-based vehicle such as a ship. In further embodiments a sandwich panel 1100 may be mounted on a land-based communication station.

In this manner, embodiments of the disclosure provide an antenna element with wide bandwidth and better than, for example, about 50-degree conical scan volume for the creation of conformal arrays and antennas. The design approach provides effective gain within, for example, about 2 to 3 dB of an ideal gain possible for a surface area of a unit-cell for an antenna element. The element design can be used as a wide-band antenna and/or array. Embodiments of the disclosure can be used in multifunction and/or shared antenna configuration for communications, electronic warfare, and signal intelligence applications and multiple combinations of multiple applications. Embodiments of the disclosure not only provide wide-bandwidth coverage, but provide polarization diversity to allow transmission and reception of signals with any arbitrary polarization that includes, but not exclusive to linear, circular, and slant polarized signals. Embodiments of the disclosure can be scaled to a frequency band with a matching bandwidth ratio (e.g. 8:1) from a highest to a lowest frequency of desired coverage.

Antenna integration into structure provides a significant advancement of aperture technologies over traditional apertures as traditional apertures are rigid/non-load bearing members and are not allowed to flex. This limits a size and locations of apertures onto aircraft. Integrating the aperture into the structure allows: 1) a larger size aperture as the aperture is the structure of the aircraft, 2) for more flexibility of the location of the aperture on the platform, and 3) the aperture to be installed in small and medium size UAV's adding to their mission capabilities.

Thus, described herein is an ultra-wide band (UWB) antenna unit cell and assembly. The antenna element may be used in the creation of wide-band arrays and/or conformal antennas that achieves ultra wide bandwidth (i.e., a 8:1 or better frequency band ratio), the ability to perform over wide scan angles, and provides both dual and separable RF polarization capability. In some embodiments the unit cell that employs a multi-layer circuit that comprises a bow-tie fan feed layer, and a layer comprising bow-tie based connected array. The circuit board may be placed over a ground plane with foam dielectric layers below and above the antenna circuit board to create the antenna element structure. A differential feed from bow-tie like fan elements is coupled capacitively to the underlying unit-cell to unit-cell connected bow-tie element layer. Such an antenna has wide applicability to communication phased antenna arrays (PAA), signal intelligence sensors and detection sensor arrays, wide band radar systems, and phased arrays used in electronic warfare.

An antenna element manufactured in accordance herewith exhibits ultra-wide bandwidth and better than 55-degree conical scan volume for the creation of conformal arrays and antennas. The design approach provides effective gain within 2 dB of the ideal gain possible for the surface area of the unit-cell for the element. The element design can be used as a wide-band antenna and/or array. The design can be scaled to any frequency band with a 8:1 or smaller ratio from the highest to the lowest frequency of desired coverage.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. An antenna unit cell, comprising:
a signal feed line;
a ground plane;
a first antenna element comprising a first antenna arm coupled to the signal feed line and a second antenna arm coupled to the ground plane; and
a first narrow-band conductor coupled to the first antenna arm and to the ground plane; and
a second narrow-band conductor coupled to the second antenna arm and to the ground plane.

2. The antenna unit cell of claim 1, the first narrow-band conductor comprises a set of connected split ring resonators.

3. The antenna unit cell of claim 1, wherein:
the antenna unit cell is operative within a frequency range between a first frequency and a second frequency; and
the first narrow-band conductor is conductive only within a predetermined frequency band between the first frequency and the second frequency.

4. The antenna unit cell of claim 1, wherein the second narrow-band conductor comprises a set of connected split ring resonators.

5. The antenna unit cell of claim 1, further comprising:
a second antenna element comprising a third antenna arm coupled to the signal feed line and a fourth antenna arm coupled to the ground plane; and
a third narrow-band conductor coupled to the first antenna arm and to the ground plane.

6. The antenna unit cell of claim 5, further comprising a fourth narrow-band conductor coupled to the fourth antenna arm and to the ground plane.

7. The antenna unit cell of claim 1, wherein the first antenna arm and the second antenna arm are disposed in planes which are substantially parallel to the ground plane.

8. The antenna unit cell of claim 1, wherein the first antenna arm and the second antenna arm are disposed in planes which are substantially perpendicular to the ground plane.

9. An antenna array comprising:
an antenna unit cell comprising:
a signal feed line;
a ground plane;
a first antenna element comprising a first antenna arm coupled to the signal feed line and a second antenna arm coupled to the ground plane;
a first narrow-band conductor coupled to the first antenna arm and to the ground plane;
a second antenna element comprising a third antenna arm coupled to the signal feed line and a fourth antenna arm coupled to the ground plane; and
a second narrow-band conductor coupled to the first antenna arm and to the ground plane.

10. The antenna array of claim 9, further comprising a third narrow-band conductor coupled to the second antenna arm and to the ground plane.

11. The antenna array of claim 9, wherein:
the antenna unit cell is operative within a frequency range between a first frequency and a second frequency; and
the first narrow-band conductor is conductive only within a predetermined frequency band between the first frequency and the second frequency.

12. The antenna array of claim 9, wherein the first narrow-band conductor comprises a set of connected split ring resonators.

13. The antenna array of claim 9, wherein the first antenna arm is capacitively coupled to the second antenna arm.

14. The antenna array of claim 9, further comprising a third narrow-band conductor coupled to the fourth antenna arm and to the ground plane.

15. The antenna array of claim 9, wherein the first antenna arm and the second antenna arm are disposed in planes which are substantially parallel to the ground plane.

16. The antenna array of claim 9, wherein the first antenna arm and the second antenna arm are disposed in planes which are substantially perpendicular to the ground plane.

17. An aircraft, comprising:
a communication system; and
an antenna assembly coupled to the communication system and comprising:
an antenna unit cell comprising:
a signal feed line;
a ground plane;
a first antenna element comprising a first antenna arm coupled to the signal feed line and a second antenna arm coupled to the ground plane;
a first narrow-band conductor coupled to the first antenna arm and to the ground plane; and
a second narrow-band conductor coupled to the second antenna arm and to the ground plane.

18. The aircraft of claim 17, wherein the first narrow-band conductor comprises a set of connected split ring resonators.

19. The aircraft of claim 17, wherein:
the antenna unit cell is operative within a frequency range between a first frequency and a second frequency; and
the first narrow-band conductor is conductive only within a predetermined frequency band between the first frequency and the second frequency.

20. The aircraft of claim 17, wherein the second narrow-band conductor comprises a set of connected split ring resonators.

* * * * *